United States Patent [19]

Ziegler

[11] Patent Number: 4,552,998

[45] Date of Patent: Nov. 12, 1985

[54] APPARATUS FOR ALTERNATIVELY AND SELECTIVELY CONNECTING TELEPHONE CABLE SHIELD GROUND STRAPS TO A GROUND ROD AND INCLUDING A GROUND BRACKET

[76] Inventor: Hans J. Ziegler, 4828 N. Newhall St., Milwaukee, Wis. 53217

[21] Appl. No.: 494,977

[22] Filed: May 16, 1983

[51] Int. Cl.[4] ..... H01H 21/00

[52] U.S. Cl. ..... 200/11 R; 200/158; 174/38

[58] Field of Search ..... 200/11 R, 11 H, 155 R, 200/158; 174/38; 179/175.3 R, 175.3 F; 339/14 R, 14 L, 14 P, 14 RP

[56] References Cited

U.S. PATENT DOCUMENTS 4,136,423 1/1979 Sterling ..... 24/122.6

4,399,336 8/1983 Greve ..... 200/11 R

*Primary Examiner*—Harry E. Moose, Jr.

*Assistant Examiner*—Morris Ginsburg

[57] ABSTRACT

Grounding apparatus for use in a telephone pedestal and the like and for use in selectively connecting and disconnecting electrically conductive shields of a telephone cable or the like to a ground rod. The grounding apparatus includes a ground block fixed to the front surface of a divider plate of the pedestal. The ground block also supports a cable ground bracket and connects the ground bracket to a ground rod. The ground bracket is adapted to facilitate grounding of the shields of service wires and the like.

34 Claims, 11 Drawing Figures

APPARATUS FOR ALTERNATIVELY AND SELECTIVELY CONNECTING TELEPHONE CABLE SHIELD GROUND STRAPS TO A GROUND ROD AND INCLUDING A GROUND BRACKET

FIELD OF THE INVENTION

This invention relates to apparatus for use in grounding electrical wires and cables and, more particularly, to apparatus for use in grounding the electrically conducting shields of service wires and cables such as are used in the telephone industry.

RELATED APPLICATIONS

This application is related to Applicant's co-pending U.S. patent application, Ser. No. 338,129 filed Jan. 8, 1982 and titled "Ground Bracket Assembly", now abandoned.

BACKGROUND PRIOR ART

Telephone communication and transmission cables and service lines normally include an electrically conductive shield surrounding the wires of the cables or service lines and protecting the wires from electrical interference. In the installation of such cables and service lines it is common practice to provide means for grounding of the electrically conductive shields at selected locations along the lengths of the cables. The prior art apparatus for grounding these shields commonly includes a ground strap having one end connected to the shield by a bond clamp, and an opposite end of the ground strap is bolted to a ground rod or, in many instances, to the telephone distribution closure or pedestal housing the cable loop.

It is also commonly desirable to test the continuity of the electrically conductive shields of the telephone cables by disconnecting the shields from ground and connecting test probes to the cable shields. With the prior art arrangements, each ground strap must be released from the ground rod before it can be tested, and then following testing, it must again be bolted to the ground rod.

Conventional telephone cable pedestals also have ground brackets for use in grounding the electrically conductive shields of service wires coming into the pedestal and being connected to appropriate wires of the cable. One prior art clamp arrangement for use in joining a number of service wires together and for connecting the electrically conductive shields of those service wires to a ground rod or ground wire is illustrated in the U.S. Sterling Pat. No. 4,136,423, issued Jan. 30, 1979.

One of the features of the prior art cable clamp arrangements such as that shown in the Sterling patent, is that it is necessary to insert the cables from a rearward portion of the clamp assembly and then tighten a bolt or screw which is on a forward or front side of the bracket or clamp assembly. Accordingly, the operator must have access to both the rearward and the front side of the cable clamp assembly. Additionally, since the cables must be inserted into the clamp assembly from the rearward side of the bracket or clamp assembly where access may be limited, placement or arrangement of the wires in the bracket assembly may be difficult and time consuming. Another problem associated with prior art clamp assemblies is that they commonly comprise several components which must be secured together in electrically conductive relation to provide a suitable electrical ground. If these parts are allowed to corrode or if they are improperly assembled, the electrical connection between these parts may be insufficient to achieve electrical ground.

SUMMARY OF THE INVENTION

The present invention provides an improved grounding apparatus for facilitating connection of the ground straps and the electrically conductive shields of both telephone cables and service wires to a ground rod or ground wire. In one embodiment of the apparatus of the invention, the grounding apparatus is conveniently mounted to the divider plate of a telephone cable pedestal and is connected to a ground rod. The apparatus includes a disconnect block adapted to be fixed to the divider plate or some other suitable mounting structure. The block is particularly adapted to support a pair of electrical contacts to which the straps from the electrically conductive shield of a telephone cable or the like can be conveniently attached. The disconnect block is also particularly constructed so as to further support a service wire ground clamp or bracket. The service wire ground clamp is connected to the ground wire or ground rod. The disconnect block also includes means for conveniently selectively connecting the electrical contacts to the service wire ground clamp and to the ground wire. In a preferred form of the invention, this means includes a pair of rotatable contacts each moveable between a first position wherein one of the electrical contacts is connected to the ground wire and a second position where the electrical contacts are disconnected from the ground wire in order to permit testing of the continuity of the cable shield.

In a preferred form of the invention, the electrical contacts each include a portion adapted to be connected to the ground straps and further include test points projecting from the ground disconnect block. The continuity of a cable shield is conveniently tested using the apparatus embodied in the invention by connecting an alligator clip of a test apparatus to a selected test point and then turning the associated rotatable contact, thereby disconnecting the electrical contact from the ground wire. The cable shield can then be tested for continuity.

Another feature of the apparatus embodying the invention is that the disconnect block, the electrical contacts, the ground bracket, and the rotatable contacts are constructed such that they can be conveniently and inexpensively assembled.

Another feature of the ground disconnect block embodying the invention is that it is constructed so as to be easily mounted on the divider plate of the pedestal with a minimum of hardware. Additionally, the disconnect block is constructed such that a portion of the disconnect block can extend through the divider plate. The ground straps from the telephone cable can be connected to the electrical contacts of the disconnect block from the rear side of the divider plate. The other portions of the ground disconnect block are accessible from the front side of the divider plate. This arrangement permits the installer to connect the ground straps to the disconnect block and to then close the divider plate, and then seal the divider plate to prevent access to the splice area. The installer can then connect the service wires to the terminal block and to the ground clamp assembly without needing access to the splice portion of the pedestal. This has the advantage that once the serviceman has completed the connection of the appropriate wires to the terminal block and has connected the cable shield to ground, the splice area can be closed and sealed to preclude subsequent tampering with the splicing.

The invention also provides an improved ground bracket assembly for restraining a plurality of service wires or cables together and for insuring electrical connection of the electrically conductive shields of the cables or service wires to a common ground and in such a manner that the electrically conductive shields of the cables are maintained at a common electrical potential.

The ground bracket assembly embodying the invention includes a one piece bracket body which can be joined directly to an electrical ground, and one or more compression tabs or clamp members adapted to compress a number of service wires or cables together. The bracket body and the clamp members are particularly constructed such that the bundles of service wires or cables can be firmly engaged to insure electrical contact of the shields and to effect grounding of the shields. The ground bracket assembly is also particularly constructed such that the cables can be easily inserted from the forward or front side of the assembly thereby making it easier to place the cables in the clamp assembly.

Another of the principal features of the invention is that the one piece bracket body and the associated clamp member are readily manufactured at minimum cost.

Referring more particularly to the construction of the service wire ground bracket assembly it comprises a ground bracket body adapted to be connected to an electrical ground, the body being comprised of an electrically conductive metal strip which is shaped so as to form a pair of spaced apart forwardly opening channels. The channels are joined by an integral web. The channels are each intended to house one or more service wires or the like. Means are also provided for clamping the electrically conductive shields of the service wires together in the channels in electrically conductive relation and for forcing the electrically conductive shields against the ground bracket body in electrical contact. The means for clamping includes a U-shaped or Omega shaped compression member having a pair of spaced parallel legs, one of the legs being adapted to be slidably housed in one of the channels and the other of the legs being adapted to be housed in the other of the channels. A first jaw member extends from a free end of one leg between the side walls of one of the channels and is adapted to engage the service wires therein and to force them together and against the ground bracket body. A second jaw member extends from a free end of the second leg and between the side walls of the other channel and is adapted to engage service wires in that channel and to force them together and against the ground bracket body. Means are also provided for forcing the jaw members toward the rearward wall portion to compress the service wires against the rearward wall of the ground bracket body.

Various features of the invention will be apparent by reference to the following description of a preferred embodiment, from the claims, and from the drawings.

Figure 3:
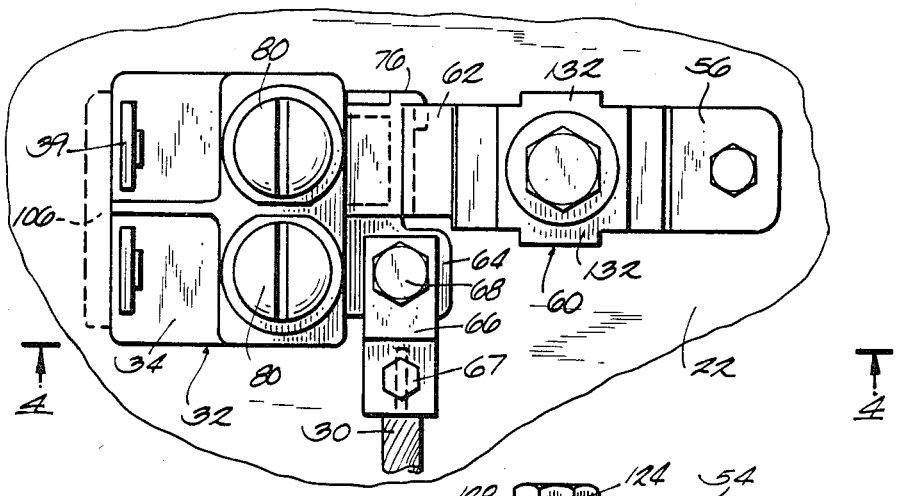
FIG. 3 is an elevation view of the ground disconnect block embodying the invention.

Before describing preferred embodiments of the invention in detail, it is to be understood that the invention is not limited to the details of construction and to the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Figure 1:
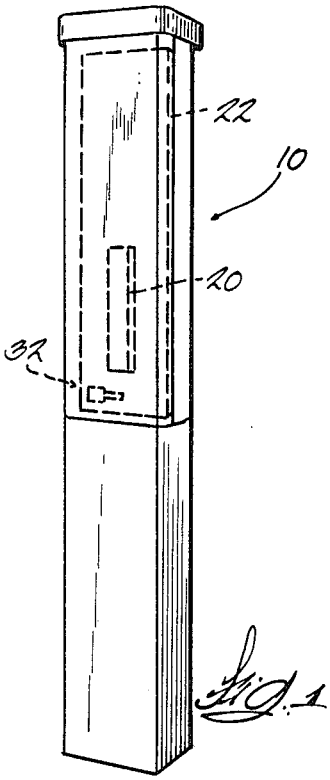
FIG. 1 is a perspective view of a typical pedestal of the type housing a telephone cable, and the pedestal housing a ground disconnect block embodying the invention.

Illustrated in FIG. 1 is a telephone closure or pedestal 10 of the type commonly employed in the telephone industry to provide a housing for means used in connection with joining service wires 12 to a buried telephone cable 14. As is well known to those skilled in the art, a loop of cable 14 extends up into the pedestal 10, and a portion of the cable 14 is stripped of its insulated sheath 16 and of the electrically conductive shield which surrounds the wires 18 of the cable 14. Selected ones of the pairs of wires 18 of the cable 14 are connected to a terminal block 20 supported by a divider plate 22 and housed in the pedestal 10. The pedestal 10 is also adapted to house the service wires 12. The service wires 12 are connected to terminals 24 of the terminal block 20 so as to be electrically connected to selected ones of the wires 18 of the cable 14. While the apparatus of the invention is useful in other applications, in the specific construction illustrated, the divider plate 22 divides the pedestal 10 into a forward cavity and a rearward cavity. The rearward cavity houses the cable loop 14. In a common form of pedestal the divider plate 22 is pivotably supported or hinged to permit access to the rearward portion of the pedestal. The forward portion of the pedestal is adapted to house the terminal block 20 and the service wires 12 to be connected to the terminal block 20. The terminal block 20 is mounted on the front face of the divider plate 22 and selected pairs of wires 18 from the loop of cable 14 are connected by splice wires 23 to terminals of the rearward face of the terminal block 20, these terminals being accessible through apertures provided in the divider plate 22.

It will be readily understood that the pedestal 10 and related structure is shown merely for purposes of example and that the apparatus embodying the invention could be employed in other applications.

In the illustrated arrangement, a cable ground strap 26 is electrically connected to each of the electrically conductive shields of the cables 14 by conventional bond clamps 28. These ground straps 26 are each intended to be connected to ground so as to provide a positive ground for the electrically conductive shields of the cables 14.

The service wires 12 also each include a plurality of wires surrounded by an electrically conductive shield, and the electrically conductive shield is in turn surrounded by an insulating sheath.

Means are also provided by the invention for facilitating connection of the ground straps 26 and the electrically conductive shields of the service wires 12 to a ground wire or a ground rod 30. This means includes a ground disconnect block 32 illustrated in the drawings as being supported by the divider plate 22 of the pedestal 10 and being electrically connected to the ground wire or ground rod 30. The ground disconnect block 32 is shown more particularly in FIGS. 3–8.

Figure 5:
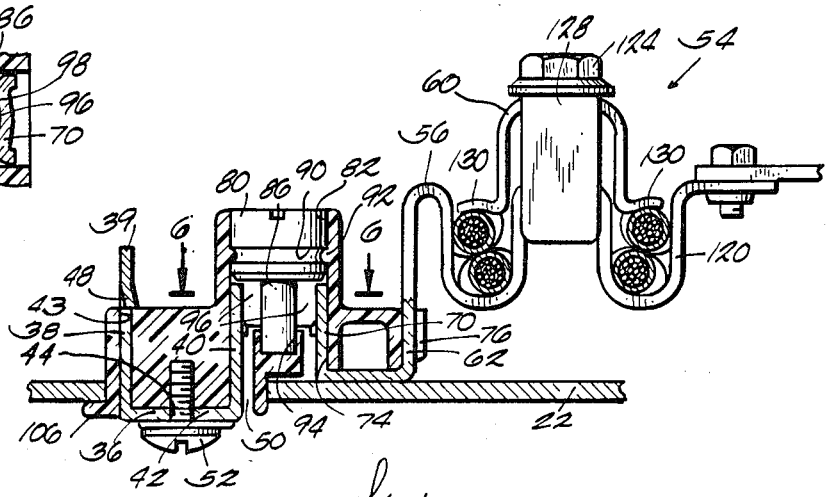
FIG. 5 is a view similar to FIG. 4, but showing the ground disconnect block partially in cross section.

In the illustrated form of the invention the ground disconnect block 32 includes a molded plastic body 34 particularly shaped so as to be conveniently attached or mounted on the front face or surface of the divider plate 22 of the pedestal 10 and so as to support a plurality of electrically conductive elements or members best shown in FIGS. 5–8. While the body 34 is described as being comprised of plastic material, in other embodiments of the invention, it could be comprised of other electrically insulative or non-conductive materials. The electrically conductive members supported by the body 34 include a pair of test contacts 36, best shown in FIGS. 5 and 7, adapted to be fixed to the molded plastic body 34. While the test contacts 36 could have various constructions, in the illustrated arrangement the test contacts 36 each include a pair of spaced apart generally parallel legs 38 and 40 joined by a bite portion 42. The bite portion 42 includes an aperture 44 adapted to house a screw 52. As shown in FIG. 5, the test contacts 36 are inserted from a rearward side of the body 34 into cavities or apertures 43 provided in the molded body 34. The forwardly extending free ends 39 of the legs 38 extend through the apertures 43 so as to project from an opposite or front side of the block 34. In a preferred form of the invention, the legs 38 of the contacts 36 include an offset central portion 48. As illustrated in FIG. 5, when the legs 38 of the test contacts 36 are forced into their respective apertures 43, when the upset portion 48 moves completely through the aperture 43, it will spring into a position precluding removal of the test contact 36 from the body 34. The forwardly projecting end 39 of the leg 38 of the test contact 36 is adapted to provide a testing member, or a test point, to be engaged by an electrical test probe as will be described.

Figure 6:
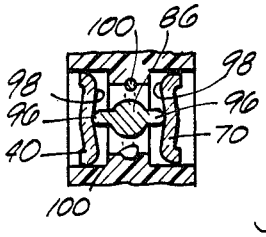
FIG. 6 is a view taken along line 6—6 in FIG. 5.

As shown in FIGS. 5–6, when the leg 38 of the test contact 36 is forced into the aperture 43 of the body 34, the other leg 40 of the test contact 36 is adapted to be received or housed in aperture 50 provided in the body 34. The leg 40 housed in aperture 50 functions to provide a switch contact as will be described.

Once the test contacts 36 are inserted into the body 34, a screw 52 (FIG. 4) can be inserted from a rearward side of the disconnect block through the aperture 44 and be threaded into the body 34. The screws 52 also provide a means for attaching the ground straps 26 to the test contacts 36.

Figure 7:
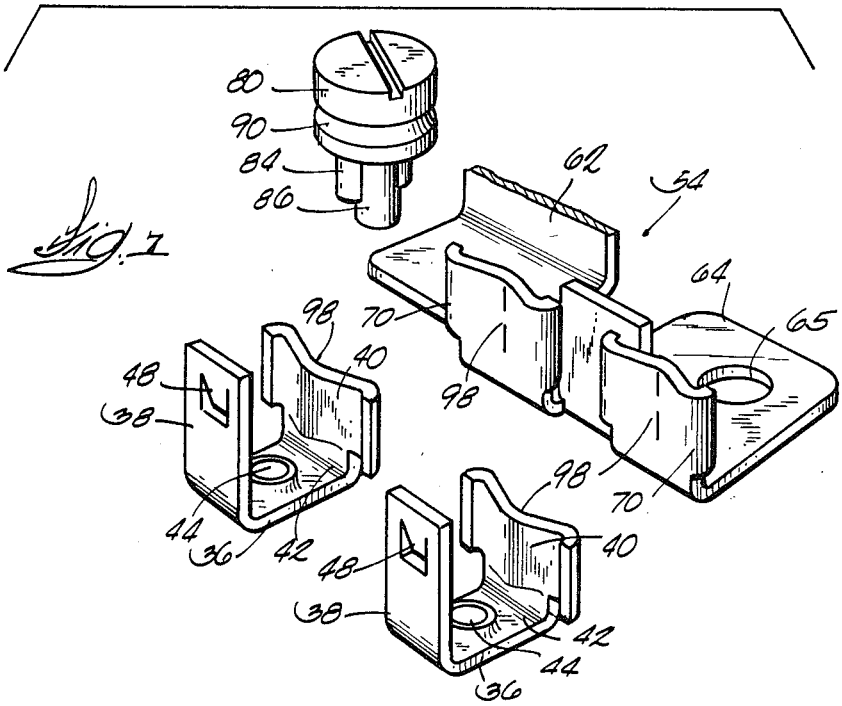
FIG. 7 is an exploded perspective view of the electrical contacts of the ground disconnect block shown in FIGS. 4–5.

The ground disconnect apparatus of the invention also includes a ground bracket or ground clamp 54 fixedly joined to the ground disconnect block 32 and adapted to provide means for connecting the electrically conductive shields of the service wires 12 to the ground wire or rod 30. While the ground bracket 54 could have other constructions, in the illustrated arrangement, the ground bracket 54 includes a ground clamp body or ground bracket body 56 comprised of an electrically conductive metal such as brass. While the specific structure of the ground bracket body 56 will be described in greater detail hereinafter, the ground bracket body 56 includes one end 58 adapted to support a clamp member 60 for clamping the service wires 12 to the ground bracket body 56, and an opposite end portion 62 of the ground bracket body 56 has a configuration particularly adapted to permit it to be joined to the ground rod or ground wire 30 and also constructed so as to permit the ground bracket body 56 to be joined in snap-fit relation to the molded plastic body 34. More particularly, the end portion 62 of the ground bracket 56 adapted to be connected to the ground rod 30 is shaped so as to include a planar boss portion 64 having a bore 65 (FIG. 7). A ground rod bracket 66 (FIG. 3) can be joined to the boss portion 64 by a bolt 68 extending through the bore 65. The ground rod or ground wire 30 is in turn housed in a bore in the ground rod bracket 66 and secured therein by a bolt 67. The ground bracket body 56 also includes a pair of electrical contacts 70 (FIGS. 5 and 7) integrally joined to the boss portion 64 of the ground bracket body 56 and adapted to be slidably housed in a pair of cavities 74 provided in the molded plastic body 34. More particularly, one of the electrical contacts 70 is adapted to be slidably forced into one of the cavities 74 in the ground disconnect block 34 and so as to be in opposed spaced apart relation from one of the legs 40 of the test contacts 36, and the other electrical contact 70 of the ground bracket body 54 is adapted to be slidably forced into the other cavity 74 in the molded plastic body 34 so as to be in opposed spaced apart relation with respect to the leg 40 of the other test contact 36. Means are also provided for causing the ground bracket body 54 to be firmly supported by the body 34 when the electricals contacts 70 are forced into the cavities 74. While the ground bracket 54 could be secured to the ground disconnect block in various ways, in the illustrated construction this means includes a hook member 76 comprising an integral molded portion of the molded plastic body 34 and adapted to surround and restrain an upper edge portion of the ground bracket body 54.

Means are also provided for selectively electrically connecting the leg 40 of one of the test contacts 36 to one of the legs 70 of the ground bracket body 54, and similar means are provided for selectively electrically connecting the leg 40 of the other test contact 36 to the other of the legs 70 of the ground bracket body 54. This means for selectively connecting includes a pair of electrically conductive contact screws 80 housed in bores 82 in the body 34, the contact screws 80 each including a lower end 84 position between a leg 40 of the test contact and a leg 70 of the ground bracket body 54. While the contact screws 80 could have other constructions, in the illustrated arrangement the contact screws 80 are adapted to be rotatably housed in the circular bores 82 of the body 34 and such that the contact screws are supported for rotation about the longitudinal axes of the bores. Means are also provided for supporting the contact screws 80 in the respective bores 82 while allowing rotation of the contact screws 80. In the preferred embodiment, the contact screws 80 include a groove 90 surrounding the head of the screw, and the internal wall of each bore 82 includes a circumferential rib 92 adapted to be housed in the groove 90 of the screws 80. The contact screws 80 can be forced or snap-fit into the bores 82 such that the circumferential rib 92 is housed in the groove 90 surrounding that contact screw 80 and so as to restrain the contact screw 80 against movement in the direction of its longitudinal axis, but to permit rotation of the contact screw 80 about its longitudinal axis.

The contact screws 80 also each include a shaft portion 86 having a free end housed in a bore 94 in the body 34 of the ground disconnect block 32. The shaft portion 86 of each contact screw 80 carries a pair of lugs or ears 96 extending along opposite sides of the shaft portion 86. The lugs 96 are adapted to engage the spaced apart contacts 40 and 70 when the contact screw 80 is in a first position, as is shown in solid lines in FIGS. 5 and 6, and thereby provide an electrical connection between the spaced contacts 40 and 70. When the contact screw 80 is rotated about its longitudinal axis 90° to the position shown in phantom in FIG. 6, the lugs 96 move away from the spaced contacts 40 and 70 and thereby break the electrical connection between the spaced contacts.

In a preferred form of the invention and as illustrated in FIGS. 6 and 7, the legs or contacts 40 and 70 are shaped so as to include a generally concave or indented surface 98 facing the contact screw 80. When the contact screw 80 is in the solid line position shown in FIG. 6, the indented surface 98 of the contacts 40 and 70 functions as a detent to releasably restrain the contact screws 80 in this position.

In a preferred form of the invention detent means will also be provided for releasably restraining the contact screw 80 in a position shown in phantom in FIG. 6. In the illustrated construction, a pair of indentations 100 are formed in the body 34 on opposite sides of the contact screw 80 and are adapted to house the edges of the lugs 96 when the contact screw is in the phantom position in FIG. 6.

In operation of the ground disconnect block arrangement described above, if it is desired to test the continuity of the electrically conductive shield surrounding the telephone cable 14, the serviceman can rotate the contact screws 80 90° from the solid line position shown in FIG. 6 to the phantom position wherein the electrical connection between the legs 40 and 70 is broken, thereby disconnecting the ground strap 26 from the ground rod 30. The serviceman can then connect a test device to the projecting test point 39 and measure the cable shield of the cable 14 for continuity.

Figure 4:
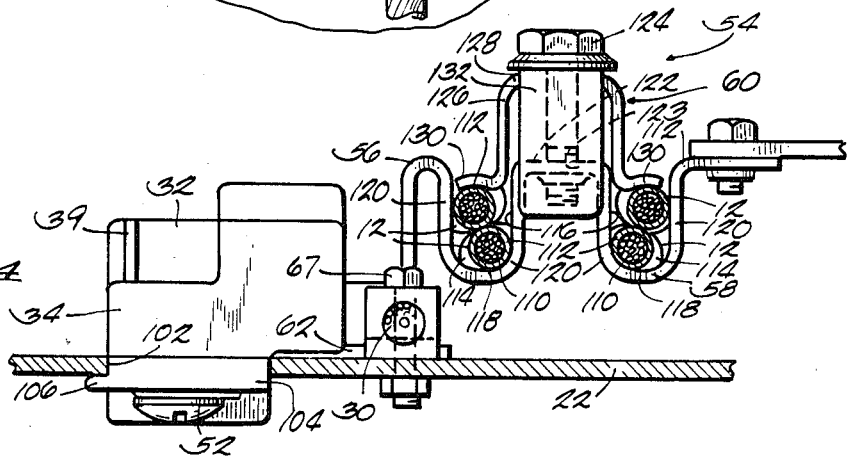
FIG. 4 is a view taken along line 4—4 in FIG. 3.

As previously stated, the ground disconnect block 32 is particularly constructed so as to be conveniently mounted to, for example, the divider plate 22 of a telephone pedestal 10. As illustrated in FIGS. 4 and 5, the divider plate 22 is conveniently provided with one or more rectangular openings 102 adapted to house a rearwardly projecting portion 104 of the ground disconnect block 32. The rearwardly projecting portion 104 of the ground disconnect block is inserted through the rectangular opening 102, and in the illustrated arrangement the ground disconnect block 32 is provided with a flange 106 adapted to engage the rearward surface of one edge of the rectangular opening 102 of the divider plate 22. While the ground disconnect block 32 could be secured to the divider plate 22 in various ways, in the illustrated construction, the ground disconnect block 32 is also held against the forward surface of the divider plate 22 by the bolt 68 connecting the ground rod bracket 66 to the ground clamp body 54. This bolt 68 can extend through a bore in the divider plate 22 to secure the ground block 32 in place.

Referring now to the function of the ground bracket 54, the illustrate service wires 12 can comprise conventional telephone service wires, each including a plurality of insulated wires 110 (FIG. 4) bundled together and surrounded by an extruded or braided shield or sheath 112 comprised of electrically conductive material, the shield 112 being adapted to be grounded and being intended to protect the wires 110 from electrical interference. The electrically conductive shield 112 is in turn surrounded by an insulative jacket 114. A portion of this insulative jacket 114 of each of the service wires 12 is removed to expose the conductive shield 112. The ground bracket assembly 54 includes a compression member 60 supported by the bracket body 56 and adapted to clamp bundles of service wires 12 together such that the electrically conductive shields 112 of those wires 12 are forced together in electrically conductive relation and so as to be suitably connected to the ground bracket body 56 which is, in turn, connected to the ground rod 30 and such that the shields 112 are all at a common electrical potential and joined to an electrical ground. The compression member 60 and the bracket body 56 provide a means for clamping a selected number of service wires 12 together in fixed disposition and to cause the shields 112 of those wires to be clamped together in electrical contact so as to be at a common potential and to provide for electrical connection between the cable shields 112 and an electrical ground.

In a preferred form of the invention, and as previously stated, the ground bracket body 56 is fabricated of a highly conductive metal such as brass in sheet or strip form, this sheet metal being stamped or otherwise bent to form a configuration as illustrated in FIGS. 3–7. More particularly, while the ground bracket body 56 may have other configurations depending upon the intended use of the bracket and its selected environment, in the illustrated arrangement, the end 58 of the bracket body 56 adapted to clamping house the service wires 12 defines a pair of forwardly opening channels 116. Each forwardly opening channel 116 is comprised of a rearward wall or base portion 118 having a forward surface and a pair of side walls 120 projecting forwardly from the rearward wall 118 at right angles. The forwardly projecting ends of the side walls 120 of adjacent channels are integrally joined by a transverse connecting boss or web 122. The transverse web 122 includes a central tapped bore 123 adapted to threadably house a screw or bolt 124. While the compression member 60 could be constructed in various ways, in one form of the invention, the compression member 60 is formed from a stamped metal strip of the same type of highly conductive metal sheet material as is employed in forming the ground bracket body 56. The compression member 60 is generally U-shaped or Omega shaped as in FIG. 4 and includes a pair of generally parallel spaced apart legs 126, the legs 126 being adapted to be slidably received in the channels 116 such that the compression member 60 is movable forwardly and rearwardly with respect to the ground bracket body 56. The legs 126 are integrally joined at their forward ends to a connecting portion or central boss 128. The central boss 128 includes a bore adapted to house the bolt 124 and being larger in diameter than the bolt 124 such that the bolt 124 is freely rotatable in the bore. When the legs 126 of the compression member 60 are housed in the cavities 116, the legs 126 are adapted to be positioned closely adjacent the side walls 120, but spaced from the side walls 120 such that the compression member 60 is freely slidably movable. The free ends or rearwardly extending ends of the legs 126 of the compression member also each include a jaw member 130 which extends transversely from that leg 126 and outwardly therefrom toward the opposed side wall 120 of the bracket body. The jaws 130 each have a free end adapted to be positioned closely adjacent the respective side wall 120 but spaced from the side wall such that the compression member 60 is freely movable toward and away from the ground bracket body 56.

In the illustrated construction means are also provided for stabilizing the compression member 60 as it engages the ground bracket body 56. This means is shown as including a pair of upper and lower tabs or ears 132 integrally joined in the upper and lower edges of the boss 128 and extending rearwardly therefrom, such that they will slide over the upper and lower edges of the web 122 and the sidewalls 120 of the channels.

In operation of the ground bracket assembly 54, the other insulative jacket 114 of each of the service wires 12 is removed to expose a length of the electrically conductive shields 112. The compression members 60 are retracted to a position such that the service wires 12 can be inserted into the channels 116 between the jaws 130 and the side walls 120 of the bracket body 58. Several such service wires 12 are bunched and placed between the side walls 120 of the channels 116. The bolt 124 is then tightened to cause the compression member 60 to move toward the rearward wall of the bracket body 58 and to cause the jaws 130 to engage the service wires 12 and to clamp the service wires 12 against the rearward walls 118, thereby clamping the electrically conductive shields 112 of the service wires together and clamping those shields 112 against the bracket body 58 to effectively ground the shields of the service wires 12.

In a preferred form of the illustrated embodiment of the invention, the threads at the end of the bolt 124 projecting through the threaded bore 123 can be upset to prevent removal of the bolt from the bracket body 58 and to restrict the range of movement of the associated compression member 60. In this arrangement, once the bolt 124 is threaded through the tapped bore 123 in the ground bracket body 56 and the threads at the end of the bolt are upset, the compression member 60 will have limited movement with respect to the bracket body 58. It is intended that the compression member 60 be movable forwardly, i.e. away from the divider plate 22, only sufficiently that service wires 12 may be freely inserted between the ends of the jaws 130 and the forward ends of the side walls 120.

One of the features of the invention is that the service wires 12 can be inserted into the ground bracket assembly 54 from the front or a forward position of the bracket assembly 54, and the bolt 124 for tightening the compression members against the bracket body is similarly accessible from the forward portion of the bracket assembly 54. Accordingly, the ground bracket assembly embodying the invention does not require the operator to reach behind the bracket assembly to insert the service wires. Another advantage of the ground bracket assembly of the invention is that the bracket assembly 54 can be secured to a flat surface such as the divider plate 22 since access to a rearward portion of the bracket assembly is not required. This construction of the bracket assembly 54 also permits construction of ground disconnect block 32 described above and mounting of the ground disconnect block 32 on the forward surface of the divider plate 22 as described. Other principal advantages of the ground bracket assembly 54 described above are that it can be easily manufactured; it includes a minimum number of component parts; and it can be constructed of strip stock and other components which are readily available.

Figure 9:
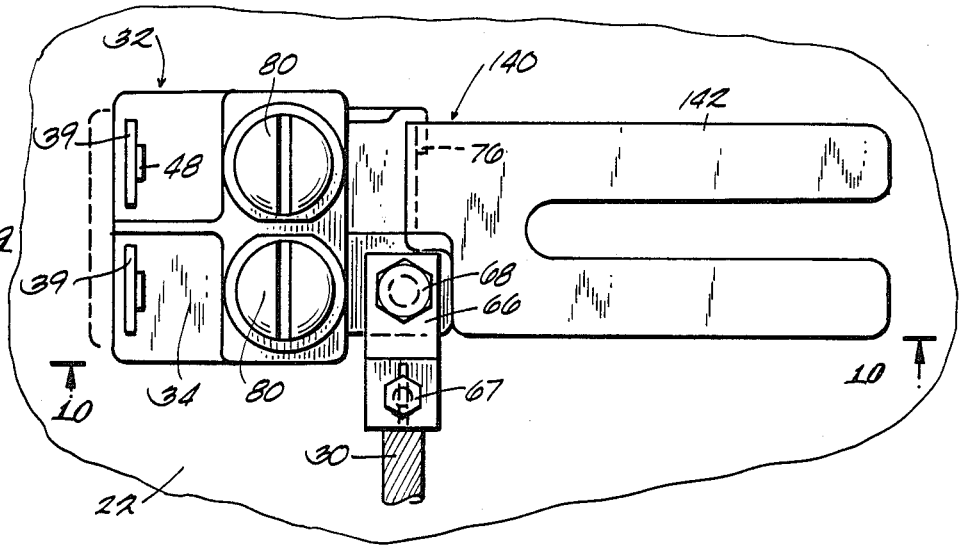
FIG. 9 is a view similar to FIG. 3 and showing an alternative embodiment of the invention.
Figure 10:
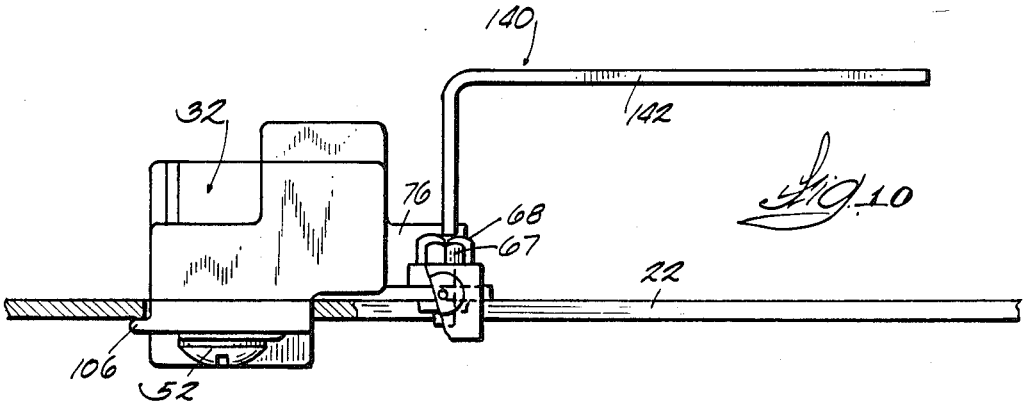
FIG. 10 is a view taken along line 10—10 in FIG. 9.

FIGS. 9 and 10 illustrate an alternative embodiment of the ground disconnect block assembly illustrated in FIGS. 1–8 and show the ground disconnect block as supporting a ground bracket 140 including one end 142 of conventional construction and adapted to support a conventional ground clamp (not shown). The opposite end of the ground bracket 140 has a configuration adapted to be joined to the ground disconnect block 32 and to the ground wire 30 in the same manner as the ground bracket 54 illustrated in FIGS. 1–8.

Figure 2:
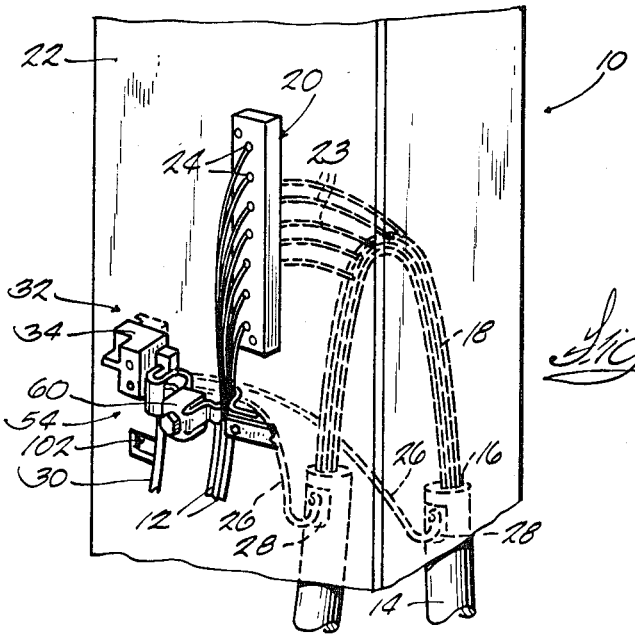
FIG. 2 is an enlarged partial view of the pedestal shown in FIG. 1 and with the front cover of the pedestal removed.
Figure 11:
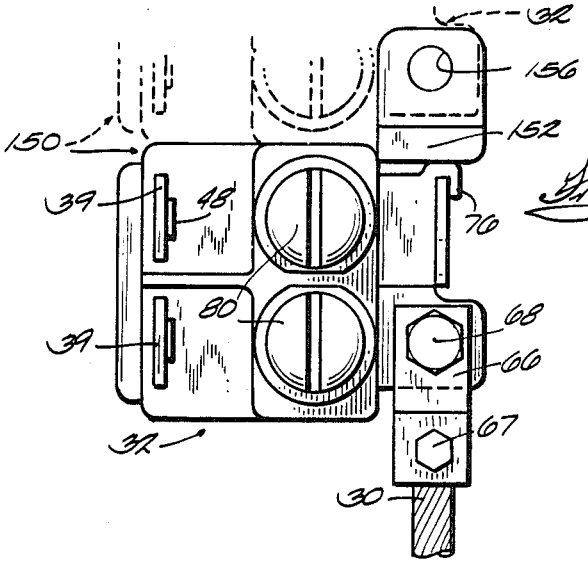
FIG. 11 is a view similar to FIGS. 3 and 9 and showing a further alternative embodiment of the invention.
Figure 8:
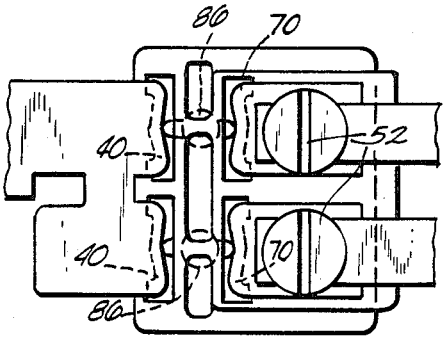
FIG. 8 is a rear elevation view of the ground disconnect block shown in FIGS. 1–7.

FIG. 11 illustrates another alternative embodiment of the ground disconnect block assembly illustrated in FIGS. 1–8, and provides means for permitting connection of two additional ground straps 26 to the ground wire 30. In some applications the pedestal 10 may house more than the single cable 14 illustrated in FIG. 2. As shown in FIG. 2, the divider plate 22 can include additional openings 102 adapted to house an add-on or redundant ground disconnect block assembly 150. The redundant ground disconnect block assembly 150 includes a ground disconnect block 32 having the same configuration as the ground disconnect block 32 shown in FIGS. 1–8, but whereas the apparatus referred to in FIGS. 1–8 includes a ground bracket 54, the redundant ground disconnect assembly 150 includes a bracket 152 adapted to facilitate attachment of the ground disconnect block assembly 150 to an adjacent ground disconnect block 32. The bracket 152 can be conveniently constructed of the same material as the ground bracket body 56 and includes a connection member 154 including a bore 156 adapted to receive a bolt, such as bolt 68, and such that the brackets 54 and 152 can be bolted together in vertically stacked relation and such that an electrical connection can be provided between the ground bracket 54 of the ground disconnect block 32 and the redundant ground disconnect block 150.

Various features of the invention are set forth in the following claims.

I claim:

1. Apparatus adapted to be supported by a support structure and for use in selectively connecting an electrically conductive shield of a cable to an eelctrical ground to ground the electrically conductive shield, and for selectively providing for disconnection of the electrically conductive cable shield from the electrical ground to facilitate testing of the electrical continuity of the electrically conductive cable shield, the apparatus comprising:

a ground disconnect block body comprised of electrically insulative material, the ground disconnect block body being adapted to be supported by the support structure, a first contact member supported by said ground disconnect block body, a first portion of said first contact member being housed in said ground disconnect block body, a second portion of said first contact member projecting from a first portion of said ground disconnect block body and comprising an electrically conductive test member, and a third portion of said first contact member projecting from a second portion of said ground disconnect block body and for connection to an electrically conductive shield of a first cable.

a second contact member supported by said ground disconnect block body, a first portion of said second contact member being housed in said ground disconnect block body and being spaced from said first portion first contact member, and a second portion of said second contact member projecting from said ground disconnect block body and being adapted to be connected to said electrical ground.

an electrically conductive member supported by said ground disconnect block body and positioned between said first portion of said first contact member and said first portion of said second contact member, said electrically conductive member being shiftable between a first position wherein a first portion of said electrically conductive member engages said first portion of said first contact member and a second portion of said electrically conductive member engages said first portion of said second contact member and wherein said electrically conductive member provides an electrical connection between said first contact member and said second contact member, and a second position wherein said first portion of said electrically conductive member is spaced from said first contact member and said second portion is spaced from said second contact member.

2. Apparatus as set forth in claim 1 wherein said ground disconnect block body is comprised of a one piece molded plastic body and includes a central aperture, and wherein said first portion of said first contact member is housed in a first portion of said central aperture and at least a portion of said second contact member is housed in a second portion of said central aperture, and wherein said electrically conductive member is housed in said central aperture between said first and second contact members and is rotatable about a central axis between said first position wherein said electrically conductive member engages said first and second contact members to electrically connect said first and second contact members and said second position wherein said electrically conductive member is spaced from said first and second contact members.

3. An apparatus as set forth in claim 2 wherein said electrically conductive member includes a first contact lug on one side of said central axis, said first contact lug being adapted to engage said first contact member when said electrically conductive member is rotated about said central axis to said first position and spaced from said first contact member when said first contact lug is rotated to said second position, and a second contact lug on an opposite side of said central axis from said first contact lug and being adapted to engage said second contact member when said electrically conductive member is rotated to said first position and spaced from said second contact member when said electrically conductive member is rotated to said second position.

4. An apparatus as set forth in claim 1 wherein said ground disconnect block body includes a forward portion and a rearward portion, said rearward portion being adapted to be supported by said support structure and further including means for connecting the electrically conductive shield of said cable to said first contact member, said means for connecting including a connector means connected to said third portion of said first contact member adjacent said rearward portion of said ground disconnect block body.

5. An apparatus as set forth in claim 1 wherein said first contact member includes a pair of spaced contact legs joined by a web, one of said spaced contact legs comprising said first portion of said first contact member and being positioned so as to be selectively engaged by said electrically conductive member and the other of said spaced contact legs comprising said electrically conductive test member.

6. An apparatus as set forth in claim 1 wherein said ground disconnect block body comprises a molded plastic block including a central aperture and wherein said electrically conductive member is adapted to be housed in said central aperture in snap fit relation.

7. Apparatus in a telephone distribution pedestal adapted to house a loop of cable including an electrically conductive shield, and the telephone distribution pedestal including a divider plate adapted to support a terminal block and separating the pedestal into a first chamber adapted to house the loop of cable and a second chamber adapted to house at least one service wire, the service wire including an electrically conductive shield, the apparatus comprising:

a ground disconnect block body comprised of electrically insulative material, the ground disconnect block body supported by the divider plate, a first contact member supported by said ground disconnect block body, a portion of said first contact member projecting from said ground disconnect block body into said second chamber to comprise an electrically conductive test member, means for connecting the electrically conductive shield of the cable to said first contact member, a second contact member supported by said ground disconnect block body, at least a portion of said second contact member being spaced from said first contact member, means for connecting said second contact member to an electrical ground, an electrically conductive member supported by said ground disconnect block body and positioned between said first contact member and said second contact member, said electrically conductive member being shiftable between a first position wherein a first portion of said electrically conductive member engages said first contact member and a second portion of said electrically conductive member engages said second contact member, and a second position wherein said first portion of said electrically conductive member is spaced from said first contact member and said second portion of said electrically conductive member is spaced from said second contact member.

8. An apparatus as set forth in claim 7 wherein said ground disconnect block body is comprised of a one piece molded plastic body and includes a central aperture, and wherein a first portion of said first contact member is housed in a first portion of said central aperture and at least a portion of said second contact member is housed in a second portion of said central aperture, and wherein said electrically conductive member is housed in said central aperture between said first and second contact members and is rotatable about a central axis between said first position wherein said electrically conductive member engages said first and second contact members to electrically connect said first and second contact members and said second position wherein said electrically conductive member is spaced from said first and second contact members.

9. An apparatus as set forth in claim 7 wherein said divider plate includes an aperture, wherein at least a portion of said ground disconnect block body is housed in said divider plate aperture, and wherein at least a portion of said means for connecting the electrically conductive shield of the cable to said first contact member is housed in said divider plate aperture.

10. An apparatus as set forth in claim 7 wherein said divider plate includes an aperture and wherein said ground disconnect block body includes a forward portion and a rearward portion, said rearward portion being adapted to be mounted against said divider plate and wherein said means for connecting the electrically conductive shield of the cable to the first contact member includes a connector means adapted to extend through said aperture in said divider plate.

11. An apparatus as set forth in claim 7 wherein said first contact member includes a pair of spaced contact legs joined by a web, one of said spaced contact legs being positioned so as to be selectively engaged by said electrically conductive member and the other of said spaced contact legs comprising said electrically conductive test member.

12. An apparatus as set forth in claim 7 wherein said ground disconnect block body comprises a one piece molded plastic block body including a central aperture and wherein said electrically conductive member is adapted to be housed in said central aperture in snap fit relation.

13. Apparatus supported by a support structure and selectively connecting an electrically conductive shield of an electrical cable to an electrical ground and connecting the electrically conductive shield of a service wire to an electrical ground, the apparatus comprising:

a ground disconnect block body comprised of electrically insulative material, the ground disconnect block body being supported by the support structure, a first contact member supported by said ground disconnect block body, at least a portion of said first contact member being housed in said ground disconnect block body, means for connecting the electrically conductive shield of the electrical cable to said first contact member, a ground bracket supported by said ground disconnect block body, said ground bracket including a second contact member, at least a portion of said second contact member being housed in said ground disconnect block body and being spaced from said portion of said first contact member, and said ground bracket including means for clampingly engaging the electrically conductive shield of the service wire, means for connecting said second contact member to an electrical ground, and means for selectively connecting said first contact member to the second contact member.

14. Apparatus as set forth in claim 13 wherein said means for selectively connecting said first contact member to the electrical ground includes an electrically conductive member supported by said ground disconnect block body and positioned between said portion of said first contact member and said portion of said second contact member, said electrically conductive member being shiftable between a first position wherein a first portion of said electrically conductive member engages said portion of said first contact member and a second portion of said electrically conductive member engages said portion of said second contact member, and a second position wherein said first portion of said electrically conductive member is spaced from said portion of said first contact member and said second portion of said electrically conductive member is spaced from said portion of said second contact member.

15. Apparatus as set forth in claim 14 wherein said ground disconnect block body is comprised of molded plastic and includes a central aperture, and wherein a first portion of said first contact member is housed in a first portion of said central aperture and at least a portion of said second contact member is housed in a second portion of said central aperture, and wherein said electrically conductive member is housed in said aperture between said first and second contact members and is rotatable about a central axis between said first position wherein said electrically conductive member engages said first and second contact members to electrically connect said first and second contact members and said second position wherein said electrically conductive member is spaced from said first and second contact members.

16. An apparatus as set forth in claim 15 wherein said electrically conductive member is rotatable about a central longitudinal axis and wherein said electrically conductive member includes a first contact lug on one side of said central longitudinal axis, said first contact lug being adapted to engage said first contact member when said electrically conductive member is rotated about said central longitudinal axis to said first position and spaced from said first contact member when said first contact lug is rotated about said central longitudinal axis to said second position and a second contact lug on an opposite side of said central longitudinal axis from said first contact lug and being adapted to engage said second contact member when said electrically conductive member is rotated to said first position.

17. An apparatus as set forth in claim 13 wherein said support structure is a divider plate of a telephone distribution pedestal including an aperture, wherein at least a portion of said ground disconnect block body is housed in said aperture, and wherein said electrical cable is adapted to be positioned on one side of said divider plate and wherein said service wire is adapated to be positioned on an opposite side of said divider plate.

18. An apparatus as set forth in claim 13 wherein said support structure includes an aperture and wherein said ground disconnect block body includes a forward portion and a rearward portion, said rearward portion being adapted to be mounted against said support structure and wherein said means for connecting the electrical conducting shield of the electrical cable to the first contact member includes a connector connected to said first contact member and adapted to extend through the aperture in said support structure.

19. An apparatus as set forth in claim 14 wherein said first contact member includes a pair of spaced contact legs joined by a web, one of said spaced contact legs being positioned so as to be selectively engaged by said electrically conductive member and the other of said spaced contact legs comprising a test leg.

20. An apparatus as set forth in claim 14 wherein said ground disconnect block body comprises a molded plastic block including a central aperture and wherein said electrically conductive member is housed in said central aperture in snap fit relation.

21. Apparatus as set forth in claim 13 and wherein said ground bracket includes a ground bracket body adapted to be connected to said electrical ground, said body being comprised of an electrically conductive formed metal strip, said formed metal strip being shaped so as to form a pair of forwardly opening U-shaped channels, each of said channels including a rearward wall portion having opposite ends and a surface for supporting cables, and a pair of side walls integral with said rearward wall portion and extending forwardly from said rearward wall portion, the forward ends of one of said side walls of one of said channels being joined by a web to a forward end of an adjacent side wall of an adjacent channel, said web including a bore, means for compressing a plurality of cables together in electrically conductive relation and for forcing at least a portion of one of said cables against said ground bracket body in electrical contact, said means for compressing a plurality of cables together in electrically conductive relation including a compression member including a pair of spaced parallel legs, one of said legs being adapted to be insertable into one of said channels, said one of said legs including an end adapted to engage cables housed in said one of said channels and to force them together and against said ground bracket body and a second leg adapted to be inserted into the other of said channels, said second leg having an end adapted to engage said cables in said other of said channels and to force them together and against said ground bracket body, and means for forcing said one of said legs and said second leg into said channels to compress the cables therein for forcing them toward said rearward wall portion.

22. Apparatus as set forth in claim 21 wherein said compression member is comprised of a U-shaped metal strip, said legs each being generally planar and said legs being joined by a transverse portion, said transverse portion having a central bore.

23. Apparatus as set forth in claim 22 wherein said means for forcing said one of said legs and said second leg toward said rearward wall portion includes a screw extending through said transverse portion and threadably housed in said bore in said web, said screw including a head adapted to engage said transverse portion whereby said head forces said transverse portion of said compression member toward said web when said screw is threaded through said bore in said web.

24. Apparatus as set forth in claim 21 wherein said compression member is comprised of a U-shaped metal strip, and wherein said legs of said compression member are each generally planar, one of said legs being slidably supported adjacent one of said side walls of one of said channels and said one of said legs including a free end defining a compression jaw transverse to said one of said legs and extending between said pair of side walls of said one of said channels.

25. Grounding apparatus in a telephone distribution pedestal housing a loop of cable including an electrically conductive shield, and the telephone distribution pedestal including a divider plate adapted to support a terminal block and adapted to separate the pedestal into a first chamber adapted to house a loop of cable and a second chamber adapted to house a second cable, the apparatus comprising a ground disconnect block body comprised of electrically insulative material and adapted to be supported by said divider plate, a first electrical contact member supported by said ground disconnect block body, means for selectively connecting the first electrical contact member to an electrical ground means, means for electrically connecting the electrically conductive shield of the loop of cable to said first contact member, and means supported by said ground disconnect block body for connecting the electrically conductive shield of the second cable to said electrical ground means.

26. The grounding apparatus as set forth in claim 25 wherein said divider plate includes a forward surface, wherein said ground disconnect block body is mounted on said forward surface of said divider plate and wherein the loop of cable is rearwardly of said divider plate.

27. The grounding apparatus as set forth in claim 26 wherein the second cable is a telephone service wire positioned forwardly of said divider plate and wherein said means for electrically connecting the electrically conductive shield of said second cable to an electrical ground means includes a ground bracket supported by said ground disconnect block body and connected to said electrical ground means.

28. The grounding apparatus as set forth in claim 25 wherein said divider plate includes an aperture, wherein at least a portion of said ground disconnect block body is housed in said aperture, wherein the electrically conductive shield of the loop of cable is connected through said aperture to said first electrical contact member.

29. The grounding apparatus as set forth in claim 25 wherein said means for electrically connecting the first electrical contact member to an electrical ground means includes means for selectively interrupting electrical connection of said first electrical contact member to the electrical ground means, said means for selectively interrupting electrical connection including a contact member shiftable from a first position wherein said first electrical contact member is connected to said electrical ground means and a second position wherein the electrical connection between said first electrical contact member and said electrical ground means is interrupted.

30. The grounding apparatus as set forth in claim 29 wherein said divider plate includes a forward surface and wherein said shiftable contact member is accessible from said forward surface of said divider plate.

31. Grounding apparatus for use with cables having electrically conductive shields and for use in connecting the electrically conductive shields of the cables to an electrical ground, and the grounding apparatus being housed in a cable housing including a support plate, the grounding apparatus comprising a ground disconnect block supported by said support plate, the ground disconnect block including a ground disconnect block body comprised of electrically insulative material, a first electrical contact member supported by said ground disconnect block body, means for selectively connecting the first electrical contact member to an electrical ground means, means for electrically connecting the electrically conductive shield of a first cable to said first contact member, and means for connecting the electrically conductive shield of a second cable to said electrical ground means.

32. Grounding apparatus as set forth in claim 31 wherein said means for electrically connecting the electrically conductive shield of the second cable to an electrical ground means includes a ground bracket supported by said ground disconnect block and connected to said electrical ground means, said ground bracket including an electrically conductive ground bracket body and means for clamping said electrically conductive shield of said second cable to said ground bracket body.

33. The grounding apparatus as set forth in claim 31 wherein said means for electrically connecting the first electrical contact member to an electrical ground means includes means for selectively interrupting electrical connection of said first electrical contact member to the electrical ground means, said means for selectively interrupting electrical connection including a contact member shiftable from a first position wherein said first electrical contact member is connected to said electrical ground means and a second position.

34. The grounding apparatus as set forth in claim 33 wherein said support plate includes a forward surface and wherein said shiftable contact member is accessible from the forward surface of said support plate.

* * * * *